United States Patent [19]

Raber et al.

[11] 4,333,093

[45] Jun. 1, 1982

[54] INTRUSION DETECTION SYSTEM

[75] Inventors: Samuel Raber, Allendale; Irving L. Ellner, Hopatcong, both of N.J.

[73] Assignee: Baker Industries, Inc., Parsippany, N.J.

[21] Appl. No.: 144,128

[22] Filed: Apr. 28, 1980

[51] Int. Cl.[3] ..... G08B 13/00; G08B 13/04; G08B 13/08

[52] U.S. Cl. ..... 340/566; 340/528; 340/636

[58] Field of Search ..... 340/566, 529, 528, 527, 340/309.1, 636

[56] References Cited

U.S. PATENT DOCUMENTS

| | | | |
|---|---|---|---|
| 3,639,897 | 2/1972 | Teich | 340/527 |
| 4,134,109 | 1/1979 | McCormick et al. | 340/550 |
| 4,139,846 | 2/1979 | Conforti | 340/636 |

*Primary Examiner*—Glen R. Swann, III
*Attorney, Agent, or Firm*—James J. Jennings

[57] ABSTRACT

An intrusion detection system includes a vibration sensor, and a gate circuit operable to provide an output signal only after the vibration sensor produces a first signal, and thereafter a second, separate signal within a preassigned "sensing window" period. To accomplish this, a timer circuit initiated by the sensor determines a timing interval, and a delay circuit coupled to the timing circuit prevents switching of the gate circuit until preset delay time has elapsed. After the delayed time, if a second sensor output signal is received before expiration of the timing interval, the gate circuit switches and passes a signal through an integrated circuit amplifier stage, and a driver circuit to energize an output unit. The sensitivity of the vibration sensor can be adjusted. The integrated circuit stage includes circuitry for maintaining the alarm signal even if the system is switched to off after it goes into alarm. The same stage also checks periodically for a low battery condition, and provides an output warning signal if the battery level falls below a preset level.

14 Claims, 7 Drawing Figures

FIG. 1
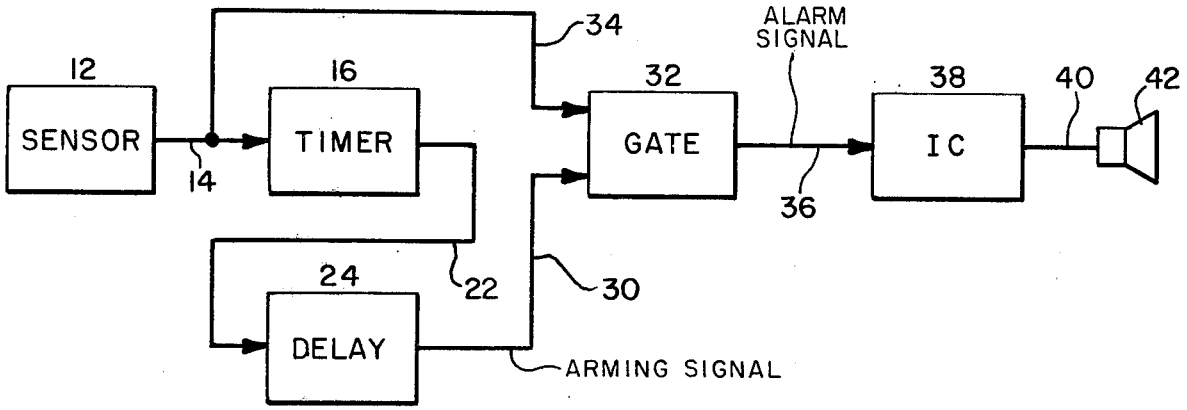
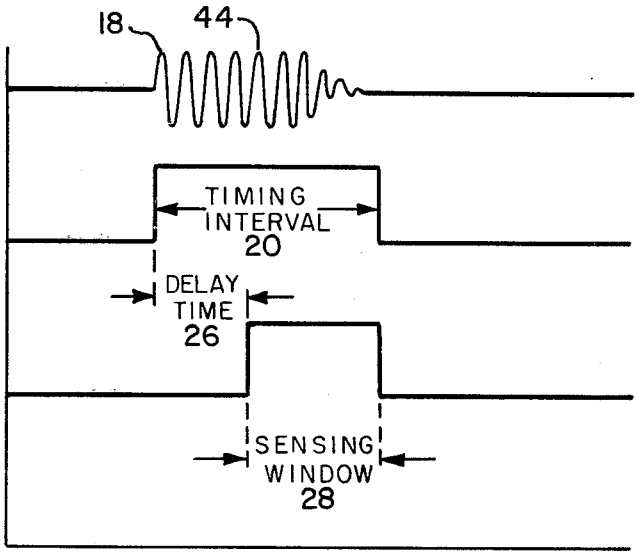
FIG. 2A
FIG. 2B
FIG. 2C
FIG. 5
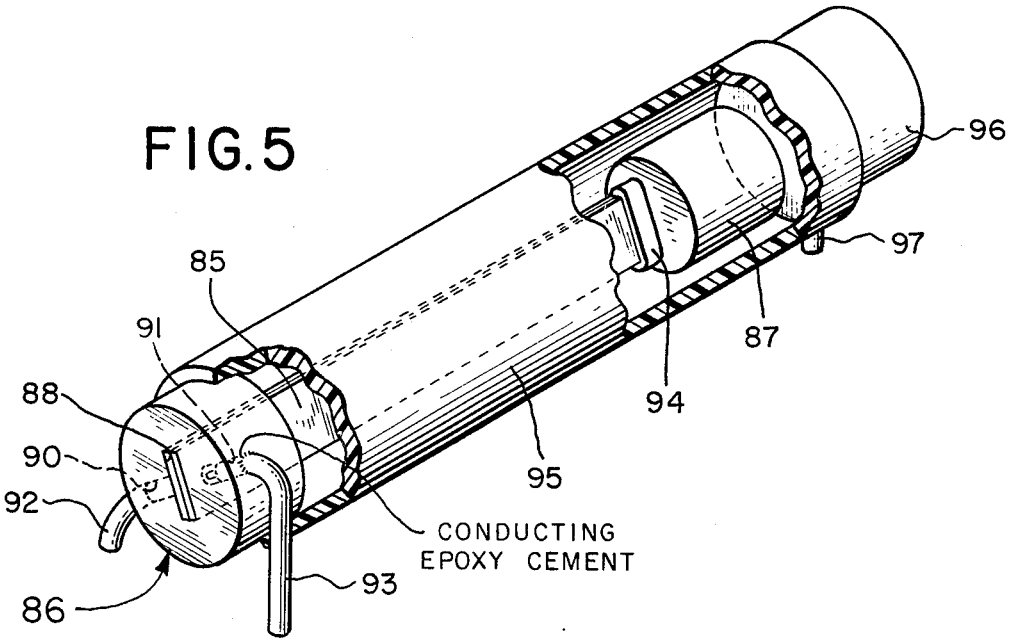

INTRUSION DETECTION SYSTEM

BACKGROUND OF THE INVENTION

This invention relates to an intrusion detection system for providing an alarm responsive to intrusion upon residential or industrial premises.

In present-day electronic security systems, there are a wide variety of intrusion-detecting transducers. For example, magnetic switch transducers are used to detect the opening or closing of windows and doors. There are also ultrasonic motion detectors and vibration sensors, as well as other detecting devices. With all of these transducers or sensors, some provision is made to provide an alarm after the system is set (armed) and an intrusion takes place. Most known security systems require a control station from which the individual intrusion system can be armed and monitored, and additionally require the use of wiring from such control station to the sensors in the system.

Many intrusion detection systems utilize normally-closed magnetic switches on the windows and doors. Such switches include a magnet portion and a contact portion. When a double-hung window or a door is opened, the magnet portion is moved away from its associated contact portion, and an alarm is sounded. When magnetic switches are used on windows, a significant disadvantage results in that the window may be broken, all of the glass removed, and an intruder may enter without producing an alarm condition. This disadvantage occurs since the magnetic switch can only be operated when the double-hung window or the door is physically displaced to separate the magnet from the associated contacts.

Systems have been designed which utilize a vibration sensor for producing an alarm. When such systems have been mounted on windows and doors, a significant number of false alarms have occurred due to the presence of environmental vibrations not associated with the unauthorized intrusion into a residence or an industrial enclosure. In order to reduce the number of false alarms generated with vibration sensors, existing equipment must be set to operate at a reduced sensitivity level. However such lowering of the sensitivity level makes the system considerably more susceptible to defeat by an intruder who does not produce vibrations of an amplitude requisite to trigger the lowered-sensitivity equipment during entry to the guarded premises.

It is therefore a primary object of the present invention to provide an intrusion detection system particularly useful with a vibration sensor, and which does not require reduction of the system's sensitivity to minimize false alarms generated by spurious vibrations.

Self-contained intrusion detection systems have previously been designed for mounting directly to doors and/or windows. These systems typically have a key-operated power switch, to prevent the intruder from disconnecting the power after the system has detected the intruder's presence and has begun to produce an alarm signal. Use of the key-operated switch increases the cost of the equipment, and has a further disadvantage in that the key may be lost or misplaced.

Another important object of the invention is to provide an intrusion detection system which initiates the alarm signal upon intrusion, and thereafter maintains the alarm signal for a present minimum time period even if the system's power switch is displaced to its "off" position.

SUMMARY OF THE INVENTION

An intrusion detection system constructed in accordance with this invention produces an alarm signal responsive to recurrence of a given condition, such as a vibration-causing movement. The detection system includes a vibration sensor, connected to produce an output signal responsive to each occurrence of such vibration-causing movement. A timing means is connected to produce a time period of preset duration, upon receipt of the first output signal from the vibration sensor and the subsequent expiration of a predetermined delay time. A sensing window is produced by a gate circuit, connected to be armed (conditioned for operation) at the expiration of the delay time, and to be triggered into operation upon receipt of the first vibration sensor output signal subsequent to the expiration of the predetermined delay time. In this way, the alarm signal is produced only after the delay time has expired, and then at least one additional vibration sensor output signal has been produced, denoting the earlier output signal was not a spurious or random occurrence.

THE DRAWINGS

In the several figures of the drawings, like reference numerals identify like components, and in those drawings:

FIG. 1 is a block diagram of significant subsystems in the intrusion detection system of this invention;

FIGS. 2A, 2B and 2C are graphical illustrations useful in understanding operation of the system shown in FIG. 1;

FIG. 5 is a perspective illustration of a vibration sensor found useful with the invention.

GENERAL SYSTEM DESCRIPTION

Figure 3:
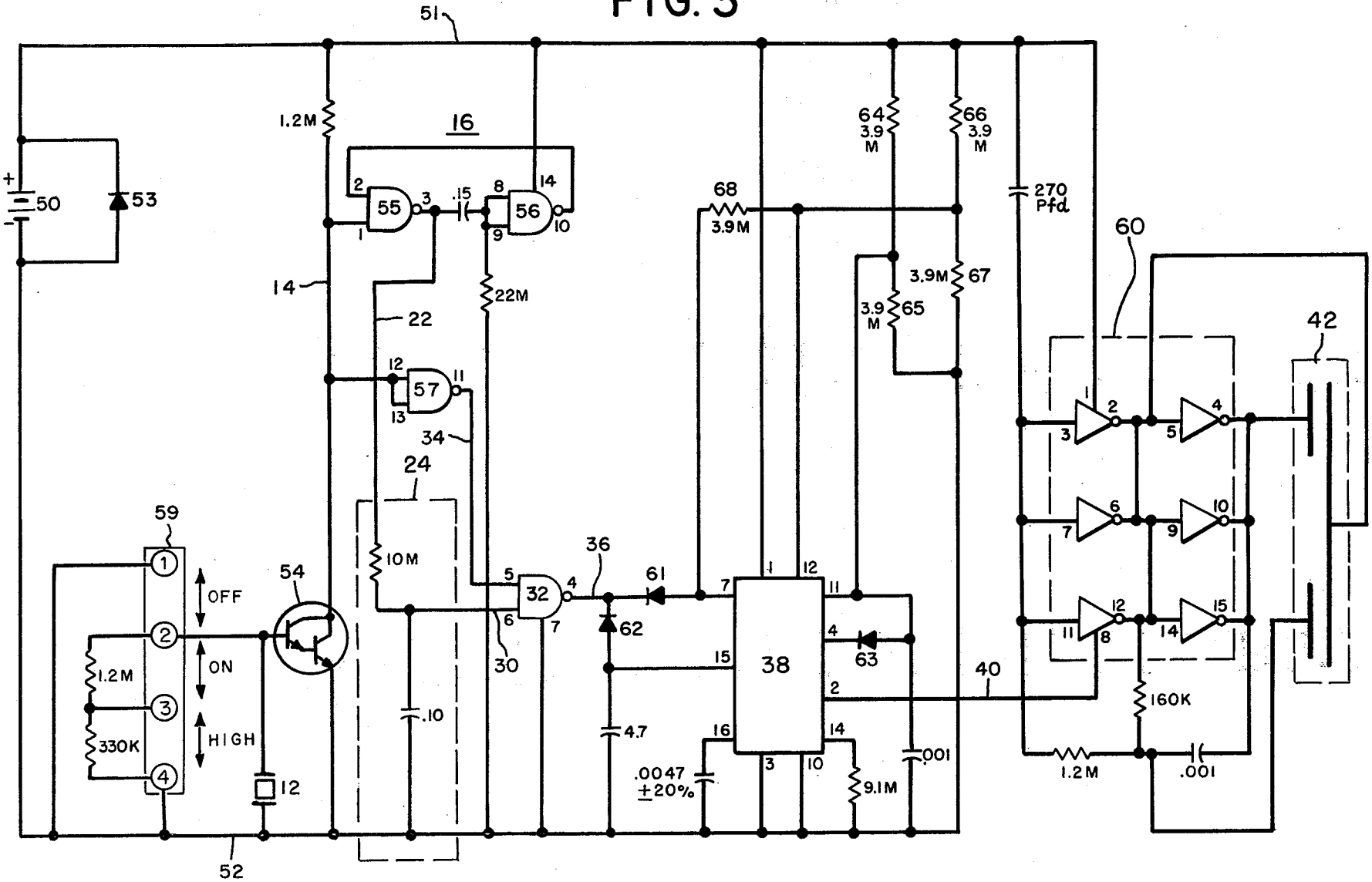
FIG. 3 is a schematic diagram setting out circuit details of the system shown more generally in FIG. 1.

FIG. 1 depicts in block arrangement the major subsystems of an intrusion detection system 10 constructed in accordance with this invention. Broadly this system is designed to produce an alarm signal, responsive to the following conditions. Initially a sensor 12 provides a first vibration signal responsive to detection of some movement, which initiates a timing interval. After expiration of a delay time, which begins when the timing interval commences, the system "looks" for a second vibration signal. This signal must occur within a "sensing window" of predetermined time duration. If a subsequent vibration occurs during the sensing window, this indicates that the first vibration was not a spurious or random occurrence, and the system produces an output alarm to indicate to the person monitoring the system that an unauthorized intrusion has been detected.

In more detail, sensor 12 can be a vibration sensor, sometimes termed a seismic sensor, which vibrates to produce an output signal on line 14 in response to detection of a vibration occasioned by movement (whether of a person, falling glass if a window is broken, a window or door opening or other displacement). A timer 16 is coupled over line 14 to the sensor, and timer 16 establishes a timing interval upon receipt of the first output signal from sensor 12. The operation of the subsystems in FIG. 1 is better understood by simultaneously considering FIGS. 2A, 2B and 2C. A series of output signals or pulse train is represented by the successive pulses shown in FIG. 2A. For purposes of this explanation, 18 references the first sensor output signal caused by a detected movement in the area guarded by the intrusion detection system. This signal is passed over line 14 to timer 16, which initiates a timing interval 20 in FIG. 2B. At the same time that the timing interval generation is initiated, timer 16 passes an output signal over line 22 to a delay stage 24, connected to produce a delay time 26 in FIGS. 2B and 2C. The timer and delay circuits can be considered as together broadly comprising a timing means which is connected to establish a sensing window, referenced 28 in FIG. 2C, or critical time period during which a second vibration signal must be detected if the system is to provide an alarm output signal. At the end of the delay time 26, delay stage 24 passes an arming output signal over line 30 to gate circuit 32, arming the gate circuit for operation if a subsequent vibration-indicating output signal is received over line 34 from vibration sensor 12. At the end of the sensing window or critical sensing time duration, gate 32 is disarmed, as the arming signal is no longer present on line 30. Thereafter another series of events must occur to again place the system in condition to produce an alarm output signal on line 36, connected to gate 32. Also shown in FIG. 1 is an integrated circuit stage 38 to amplify the alarm signal and pass it over line 40 to some transducer 42, such as a conventional piezoelectric horn or other means for converting electrical energy into an audible alarm signal. Of course, the signal on line 40 can be used directly to energize lights in an annunciator panel, to selectively energize relays or some other indicating arrangements, or for any other alarm end use. It is important at this time to again emphasize that for the alarm signal to be produced on line 36, the following events must occur in sequence.

First, there must be an initial output signal such as that referenced 18 in FIG. 2A from the sensor, to energize the timer and commence producing the timing interval 20, and likewise cause delay circuit 24 to commence generation of the delay time period 26. Subtraction of the delay time from the timing interval produces sensing window 28, during which the arming signal is present at one input connection of gate 32. This arming condition on the gate is the second condition requisite to production of the alarm signal. Thus the first vibration cannot cause the generation of the alarm signal, as it has terminated prior to expiration of the delay time, and before the sensing window commences. The third condition requisite to produce the alarm signal on line 36 is the production of another vibration or sensor output signal 44 on line 14 after the sensing window period has begun and before it has ended, for passage over line 34 to the other input connection of gate 32. Because the gate has been armed by the signal on line 30, this gate is switched in its operation to produce the alarm output signal on line 36. With this broad perspective of the invention, a more detailed system description will now be set out.

DETAILED DESCRIPTION OF THE INVENTION

FIG. 3 illustrates schematic details of the subsystems shown more generally in FIG. 1. As there shown, a battery 50, which is a 9 volt battery in a preferred embodiment, is coupled between conductors 51, 52 to provide an energizing potential difference. A protective diode 53 is coupled in parallel with battery 50. Of course any other source of energizing potential difference can be utilized to provide a voltage of approximately 9 volts between conductors 51, 52 and energize the circuit components.

Seismic sensor 12 is shown coupled at one side to conductor 52, and at its other side to the common connection between the base of a Darlington transistor amplifier 54 and one terminal of a control switch 59. This is a conventional switch operable to three different positions: "off", where the base of the Darlington amplifier is grounded over switch connection 1; "on", in which the 330K resistor is coupled between the base of 54 and the circuit reference conductor 52; and "high", in which the 1.2 M resistor is provided in the base circuit. The collector of the Darlington amplifier 54 is coupled to conductor 14, and a 1.2 M resistor is coupled between conductors 14 and 51. The emitter of the Darlington is connected to conductor 52.

Timer circuit 16 comprises gate circuits 55 and 56, intercoupled in a conventional one-shot multivibrator configuration as shown. The gates 55, 56, together with another gate 57 and output gate 32, are all formed on a single chip (CMOS quad 2-input NAND gate, 4011), and hence the terminal connection markings (1–14) have been shown to assist those skilled in the art to make and use the invention with a minimum of experimentation. The period of timer 16 is controlled by the 0.15 microfarad capacitor coupled between output terminal 3 of gate 55 and input terminals 8 and 9 of gate 56, in conjunction with the 22 megohm resistor. This resistor is coupled between conductor 52 and the common connection between the capacitor and terminals 8, 9 of gate 56. Terminal 1 of gate 55 is connected to conductor 14 to receive an input signal, and there is a feedback connection between output terminal 10 of gate 56 and input connection 2 of gate 55.

The output connection from timer circuit 16 is from terminal 3 of gate 55 over conductor 22 to delay circuit 24. In the present embodiment, the delay circuit is comprised of a 10 megohm resistor and a 0.10 microfarad capacitor. One side of the resistor is connected to conductor 22, and the other side is coupled to the common connection between the capacitor and input connection 6 of gate 32. The other side of the capacitor is connected to conductor 52. The other input connection 5 of gate 32 is coupled over conductor 34 to output connection 11 of another gate 57, which has its input terminals 12, 13 connected to conductor 14. This gate 57 provides a path for all vibration signals from sensor 12 to the gate 32, including those signals occurring after the sensing window 28 has been initiated by operation of timer circuit 16 and delay circuit 24.

Integrated circuit 38 is connected to receive the vibration-indicating signals from gate 32, and to provide a signal which is amplified in horn driver circuit 60 to drive the piezoelectric horn 42 or any other suitable alarm-indicating arrangement. The details of integrated circuit 38 are set out in FIG. 4. For the present it is sufficient to indicate in FIG. 3 that diode 61 is coupled between pin 7 of IC 38 and the output side of gate 32, and another diode 62 is coupled between pin 15 of IC 38 and the output side of gate 32. These diodes provide isolation between pin connectors 7 and 15 of the integrated circuit. Pin 15 is also coupled to one side of a 4.7 microfarad capacitor, the other side of which is coupled to conductor 52. A 0.0047 microfarad capacitor is coupled between pin 16 and conductor 52. Each of pins 3 and 10, representing the high and low current ground connections, are coupled directly to conductor 52. Pin 14 is coupled to one side of a 9.1 megohm resistor, the other side of which is connected to conductor 52. Pin 2, the output connection of the integrated circuit, is coupled over conductor 40 to an input connection of the driver circuit 60. Pin 4 is coupled to the cathode of a diode 63, the anode of which is coupled both to pin 11 and to one side of a 0.001 microfarad capacitor, the other side of which is connected to conductor 52. Pin 11 is also coupled to the common connection between a first pair of 3.9 megohm resistors 64 and 65. These resistors, like the adjacent pair 66, 67, are coupled between conductors 51, 52. The intermediate connection between resistors 66, 67 is coupled directly to pin 12 of IC 38 and, through another 3.9 megohm resistor 68, to the common connection between pin 7 and the anode of diode 61. Pin 1 of the IC is connected directly to conductor 51 and, for purposes of the subsequent explanation, the voltage on line 51 with respect to that on conductor 52 will be referenced $V_{cc}$. Because of the voltage divider effect of the 3.9 megohm resistors 64 and 65, a voltage of ½ Vcc appears at pin 11 of IC 38 and, before there is any current flow through diode 61, a similar voltage is applied to pin 7 as well as pin 12. The full $V_{cc}$ is applied to pin 1.

The 270 picofarad capacitor shown between conductor 51 and one input line of the horn driver chip 60 (CMOS hex inverter, 4049) is utilized to assist in tuning the horn to produce a 3.2 kilohertz signal when the driving signal is passed from IC 38 over line 40 to the driver circuit. Those skilled in the art will appreciate that the driver chip and the horn circuit 42 (comprising a ceramic horn element manufactured by Kyocera, Part No. KBS-35DA-3FCS and a holder and resonator manufactured by Molex, Part. No. ATM-3773P) are readily available commercial units.

To operate this system, a battery 50 is connected as shown between conductors 51 and 52, and the off-on-high switch 55 is placed in the "on", or in the "high", position. In the "on" position, as illustrated in the drawing, the 1.2 megohm resistor is shorted out, leaving the 330 kilohm resistor in parallel with vibration sensor 12. In certain environments where the background vibrations are much less than in a normal urban environment, the "high" sensitivity position can be selected by displacing the slider of switch 59 to contact the 3 and 4 terminals, thereby shorting out the 330 kilohm resistor and placing only the 1.2 megohm resistor in parallel with the seismic sensor. When a movement in the adjacent area causes a vibration of sensor 12, this sensor produces an alternating output voltage which is applied between the base and the emitter of the Darlington transistor 54. When the positive-going excursion of the voltage from sensor 12 exceeds the base-emitter voltage of transistor 54, this transistor is switched on and rapidly goes into conduction, so that its collector voltage rapidly approaches zero. This in effect causes a negative-going voltage to appear on line 14, and this negative-going signal is applied to both gates 55 and 57.

The first negative-going pulse on line 14 is applied to input connection 1 of gate 55, the input portion of timer circuit 16. This signal is inverted in gate 55, and a positive-going output signal from terminal 3 is applied through the 0.15 microfarad capacitor to the input side of gate 56, producing a negative-going output signal at output connection 10. This negative-going signal is passed over the described feedback loop to input connection 2 of gate 55, reinforcing the fast transition in the output signal from connection 3 of gate 55, which output signal is passed over line 22 to delay circuit 24. The time period of this one-shot multivibrator is set by the 22 megohm resistor and 0.15 microfarad capacitor, and is calculated so that in the worst-case tolerance condition of both these components, the timing interval 20 will still be approximately two seconds as a minimum. At the end of the timing interval, the output of gate 55 on line 22 returns to zero from its high condition, approximately as shown in FIG. 2B of the drawing.

At the start of timing interval 20, when gate 55 initially went high to start the operation of timer circuit 16, this initial positive-going signal was also passed over line 22 to delay circuit 24, at the upper end of the 10 megohm resistor. The 0.10 microfarad capacitor in the delay circuit begins to charge toward the positive voltage at the upper end of the 10 megohm resistor. At a certain threshold level the voltage at the upper end of the capacitor, which is also that on line 30 passed to input connection 6 of gate 32, reaches a level such that gate 32 is armed, that is, conditioned for conduction upon receipt of a positive-going pulse over line 34 from gate 57. When this arming level is reached on line 30, this marks the end of delay time 26 and the onset of sensing window time 28. The beginning of the sensing window is from the end of the delay time, marked by the charging time of the 0.10 microfarad capacitor through the 10 meg resistor, which is in effect subtracted from the timing interval 20. At the end of the timing interval 20, the timing circuit 16 returns to its initial condition, so that the voltage on line 22 goes low, and this also terminates the end of the sensing window as the arming voltage is no longer present on input connection 6 of gate 32.

However, if between the beginning and the end of sensing window 28 another vibration is sensed by the sensor 12, the output of the Darlington transistor 54 again produces a negative-going pulse which is inverted in gate 57, and the resultant positive-going pulse is supplied over line 34 to gate 32, triggering this gate into conduction and providing a negative-going output pulse on line 36. This signal on line 36 is passed through IC 38 and used, after amplification in driver circuit 60, to provide an audible output alarm from the horn 42. To assist those skilled in the art to make and use the invention, the type of IC now used for unit 38, and the construction of sensor 12, will now be described.

Figure 4:
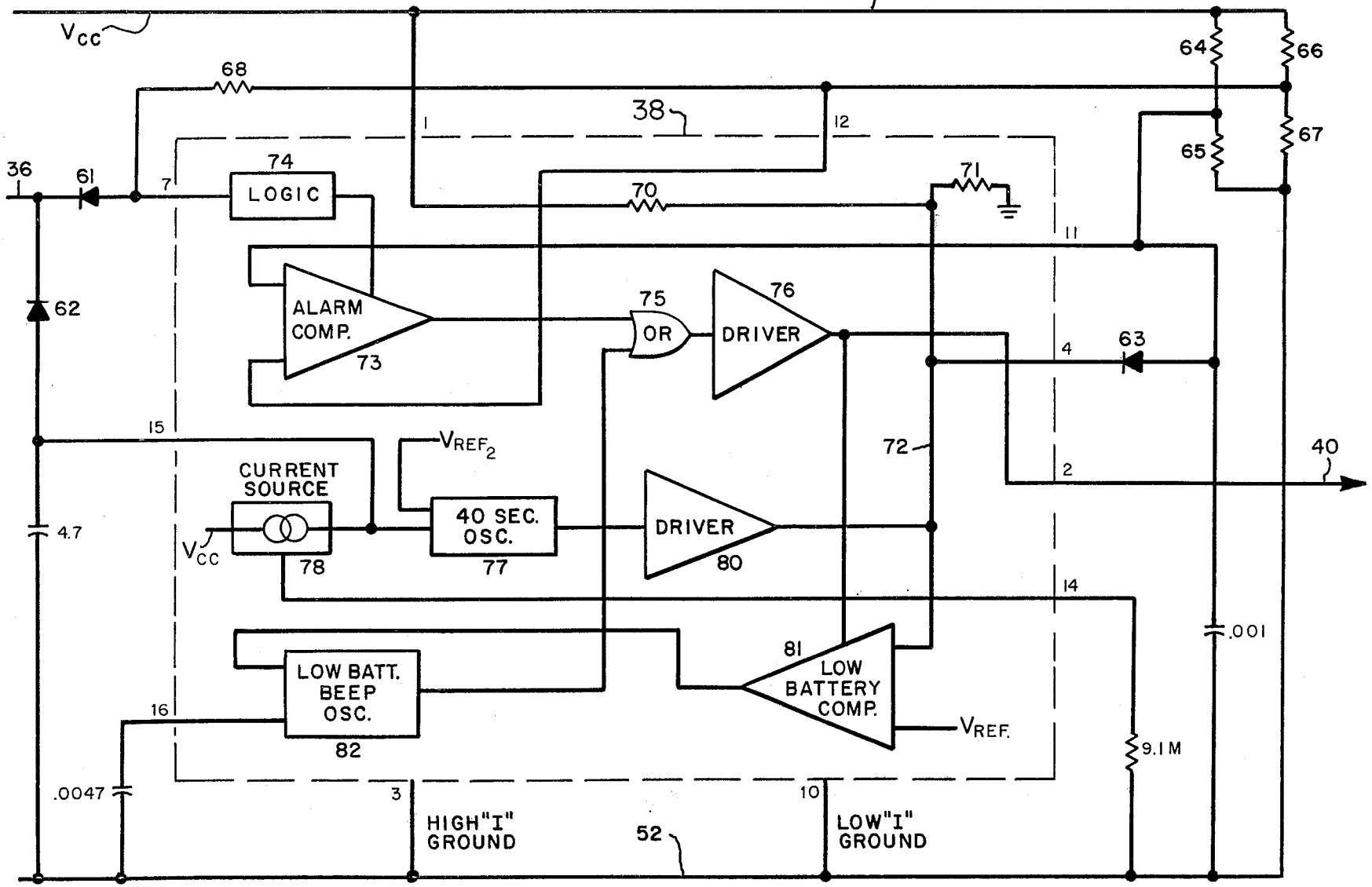
FIG. 4 is a functional block diagram of one subsystem shown in FIGS. 1 and 3.

FIG. 4 depicts details of IC 38 in schematic form. Diodes 61, 62 provide isolation between pins 7 and 15 of IC 38. With battery 50 connected in the system, a voltage denoted by $V_{cc}$ appears on line 51, and is applied to pin 1 of the IC. Internally this pin is connected through a voltage divider pair of resistors 70, 71 so that a portion of the supply voltage appears on common line 72. The same supply voltage between lines 51, 52 is applied across each of the series-connected resistor pairs 64, 65 and 66, 67. Thus a voltage of one-half the supply voltage is taken from the common connection between resistors 64, 65 and applied over pin 11 of IC 38 to one input connection of alarm comparator stage 73. The connection of the 0.001 microfarad capacitor to pin 11 prevents the circuit from going into an alarm condition when power is initially supplied between conductors 51, 52. Pin 12 of IC 38 is connected into the voltage divider circuit between resistor 68 and the common connection between resistors 66 and 67; hence the voltage supplied over pin 12 to the other input connection of alarm capacitor 73 is somewhat above one-half the supply voltage. Logic circuit 74 is connected as shown to provide a feedback path to pin 7 of the IC, for pulling down the no-alarm high voltage level at that pin when alarm capacitor stage 73 switches. The output signal path from comparator 73 is through an OR stage 75 and a driver stage 76 to pin 2, which provides the output signal over conductor 40 to the horn driver circuit when IC 38 goes into an alarm condition.

The stage 77, designated "forty second oscillator", is a conventional programmable unijunction transistor (PUT), which receives a charging current from source stage 78 to provide an output pulse through driver stage 80 every time the PUT fires, about every 40 seconds. The output of driver 80 is coupled to common line 72, which is also provided as one input connection to low battery comparator stage 81, which receives a reference voltage over its other input line. The output side of comparator 81 is coupled to one input connection of a low-battery beep oscillator 82, the other input connection of which is coupled to input pin 16. The output side of beep oscilattor 82 is connected to the other input connection of OR circuit 75.

In operation, when an alarm signal from gate circuit 32 (FIG. 3) is presented over conductor 36 to the common cathodes of diodes 61, 62 in FIG. 4, diode 61 conducts and pulls down the voltage at pin 12 of IC 38, reducing this voltage below a level of one-half the supply voltage. This causes alarm comparator stage 73 to switch, passing an output signal through OR stage 75 and driver stage 76 to pin 2, providing a negative going signal which acts as a power ground for the horn driver circuit. At the same time the alarm comparator stage 73 switches, a feedback signal is provided through logic stage 74 to pull the voltage at pin 7 low, thus maintaining the voltage at pin 12 low and latching the circuit of IC 38 in the alarm condition.

Considering the reset function, at the same instant that the alarm circuit is latched, the 4.7 microfarad capacitor at pin 15 discharges through diode 62. When the input vibration ceases, the voltage on line 36 returns to its high state and the 4.7 microfarad capacitor again begins to charge towards the supply voltage $V_{cc}$, through the current source stage 78. When the voltage at pin 15 is within one diode drop (across 62) of the supply voltage, or about 50 seconds after this system has latched, then oscillator stage 77 fires, and brings the voltage at pin 4 low for 1 millisecond. At this time the voltage at pin 11 is also brought to ground, through diode 63; this diode isolates pin 11 from the internal low impedance pull-up at pin 4. Thus, if there is no vibration signal present on line 36, the comparator stage 73 is reset at this time, the voltage at pin 7 returns to its high condition, and the alarm circuit is unlatched.

Considering the function of the low battery detection arragement, the operation is analogous to that of the alarm reset operation. More specifically, when oscillator 77 fires and passes a signal through driver 80 to common line 72, a circuit is completed for current flow from the supply battery at conductor 51 through pin 1 of IC 38, and resistors 70, 71 to ground. The load current drawn from the battery at this time through pin 1 is about 35 milliamperes. If the current flow is at or above this level, this signals that the battery is indeed supplying the necessary load current. This determination is made by comparing the voltage on line 72 during this pulsing interval with that of the other input connection of low battery comparator stage 81. If however the voltage on line 72 is less than the internal reference voltage at the other connection of stage 81, a signal is passed from stage 81 to low battery beep oscillator 82 which allows the 0.0047 microfarad capacitor coupled to pin 16 to rapidly charge. After the termination of the battery current flow into pin 1, the capacitor coupled to pin 16 rapidly discharges through this pin into the oscillator circuit 82, passing a signal from this oscillator through OR stage 75 and driver 76 to pin 2, bringing the voltage level at pin 2 low. The discharge of the 0.0047 microfarad capacitor takes approximately 20 milliseconds, producing a pulse of this duration from the horn 42. This completes the sequence of operation of IC 38.

As shown in FIG. 5, vibration sensor 12 may be a piezoelectric "bilam" or bilaminate member 85. Sensor 12 includes a base member 86, and cantilever member 85 extends substantially perpendicular to base member 86. A mass 87 is attached to the cantilever member at the end remote from base member 86. This arrangement provides a mass-loaded piezoelectric cantilever type sensor which is extremely sensitive and accurate in producing output electrical signals in response to vibration of cantilever member 85.

Cantilever member 85 is actually a composite flexure member of a "sandwich" type construction. In the center is a metal shim, which in a preferred embodiment was 0.002 inch thick, 0.060 inch wide, and 1.00 inch long. On each side of the shim is a piezoelectric ceramic piece of lead titanate-lead zirconate composition, or any other suitable piezoelectric ceramic. Each of the ceramic elements was 0.009 inch thick, 0.020 inch wide, and 1.00 inch in length. Thus the resultant cantilever arm was approximately 0.021 inch thick, with the same width and length dimensions as the individual shim and both ceramic pieces. It has been found that such a piezoelectric bilam functions very efficiently to produce an electrical signal in response to vibration of the type desired to sense in an intrusion detection system.

Base member 86 is generally cylindrical, and defines a slot 88 for receiving the end of the cantilever or bilam member. In addition, the base member defines a pair of opposed holes 90, 91 for receiving a pair of electrical conductors 92, 93 when the sensor is assembled. In particular, each of the holes 90, 91 is drilled in the base to have a diameter equal to the diameter of each wire lead 92, 93 to effect a good electrical contact with the end of member 85 inserted into slot 88. The base member is made of a plastic disc or cylinder of Lexan or a similar plastic. A suitable electrically conductive epoxy is injected into each of the holes 90, 91 before the conductors 92, 93 are inserted.

To improve the electrical connections to the bilam even more, a short spring wire lead (not shown) is inserted between the end of each of conductors 92, 93 and the adjacent surface of bilam 85. In a preferred embodiment, the holes 90, 91 were each 0.032 inch in diameter, and the short spring wires were of only 0.005 inch diameter, and of phosphor-bronze. In the assembly sequence, electrically conductive epoxy is first injected into the holes 90, 91, the short spring wires are then dropped into the holes, and the lead wires 92, 93 are pressed into the respective slots 90, 91. The spring wires are deformed, as the conductors are pressed in, and thus provide very good contact between conductors 92, 93 and the surfaces of bilam 85 received in slot 88. The conductors are held in the position illustrated in FIG. 5 by a suitable fixture (not shown) until the epoxy sets up.

Thus there is a very good electrical contact between each of the conductors 92, 93 and one surface of the bilam, even if a wire lead 92 or 93 does not make actual physical contact with the bilam.

In a preferred embodiment, slot 88 was formed to be 0.021 inch in height and 0.061 inch in width, providing a very good fit for the cantilever member when it is inserted into the slot. Mass 87 is attached to the end of cantilever arm 85 at the end remote from base member 86. In a preferred embodiment mass 87 was provided by a lead weight of 1.5 grams, 0.30 inch in length and 0.23 inch in diameter. An insulating sleeve 94, of shrink tubing or some similar plastic material, is provided between the mass and the bilam to prevent the conductive mass member from electrically shorting the bilam. A protective housing or sleeve 95 is then inserted over mass 87, cantilever 85 and a portion of base member 86. This solid tube or cylinder 95 in a preferred embodiment was 1.344 inch in length, with an outer diameter of 0.375 inch and an inner diameter of 0.280 inch. These dimensions provide sufficient clearance so that the bilam 85 can move sufficiently to provide a good electrical signal on conductors 92, 93 when vibration is sensed, while still restricting movement to the extent that bilam breakage is prevented if the entire unit is dropped. An end cap 96 is then inserted into the end of housing 95 as shown. A perpendicular support leg 97 can be attached either to the housing or the end plug for additional mechanical support to an adjacent surface, such as a circuit board, usually the same board to which the conductors 92, 93 are to be electrically and mechanically attached. The support leg 97 enhances the mechanical coupling between the sensor and the surface of which the vibrations are to be sensed. The completed assembly is then dipped into a coating epoxy material, providing both physical protection and effective sealing against degreasing liquids and vapors.

TECHNICAL ADVANTAGES

The present invention provides a compact and effective intrusion detection system, responding to an output signal from a vibration sensor such as that depicted in FIG. 5, or any other sensor can be utilized with the system. The inventive system utilizes timing means, such as timer circuit 16 and delay circuit 24 in FIG. 1, which cooperate to establish a sensing window of the time duration represented generally in FIG. 2C. This is accomplished by initiating timing interval 20 when the first vibration-caused output signal issues from the sensor, and concomitantly initiating predetermined delay time 26. Gate circuit 32 is armed at the expiration of the delay time, which coincides with the beginning of sensing window 28. A second vibration-caused signal must arrive during the sensing window duration to produce an alarm signal. This system minimizes spurious alarms which might otherwise be generated by random vibrations or movements. Good results have been achieved when the delay time 26 was of the order of 0.5 to 2.0 seconds, and the sensing window duration was of the order of 0.5 to 5 seconds. With the duration of the timing interval held constant, it is apparent that subtraction of the delay time from the timing interval period establishes the duration of the sensing window.

Further, the invention includes means within integrated circuit stage 38 for periodically monitoring the battery output under load conditions, and providing a low-battery signal if the battery output falls below a preset level.

Another advantage is the sensitivity adjustment means depicted by switch 59 in FIG. 3. By displacing the switch between the "on" and "high" positions, there is a corresponding variation in the amplitude of the vibration-causing movement required to provide an output signal to the timing portion of the system.

In addition, the integrated circuit stage comprises means, as explained above, for maintaining propagation of the audible output signal from horn 42 for a predetermined time period, even if the adjustment means or sensitivity switch 59 has been actuated to deenergize the system by movement to the "off" position.

While only a particular embodiment of the invention has been described and illustrated, it is manifest that various modifications and alterations may be made therein. It is therefore the intention in the appended claims to cover all such modifications and alterations as may fall within the true spirit and scope of the invention.

What is claimed is:

1. An intrusion detection system for producing an alarm signal responsive to the repetition of a vibration-causing movement, comprising:

a vibration sensor, connected to produce an output signal responsive to each occurrence of the vibration-causing movement;

timing means connected to establish a sensing window which is initiated upon the expiration of a predetermined delay time commenced by receipt of the first sensor output signal; and a gate circuit, connected to be armed at the expiration of said delay time and to be triggered upon receipt of the first sensor output signal subsequent to the expiration of the predetermined delay time and prior to the expiration of said sensing window, thus producing the alarm signal only after the delay time has expired and at least one additional sensor output signal has been produced.

2. An intrusion detection system as claimed in claim 1, in which the predetermined delay time is of the order of 0.5 to 2.0 seconds.

3. An intrusion detection system as claimed in claim 1, in which the sensing window duration is of the order of 0.5 to 5.0 seconds.

4. An intrusion detection system as claimed in claim 1, and further comprising a transducer coupled to the gate circuit, for translating the alarm signal into a system output signal.

5. An intrusion detection system as claimed in claim 4, in which the transducer is a piezoelectric horn for converting the alarm signal into an audible system output signal.

6. An intrusion detection system as claimed in claim 1, further comprising a battery for energizing the system, and an integrated circuit stage including a comparator means, operable periodically to monitor the battery output under load conditions, and to provide a low-battery signal when the battery output falls below a preset level.

7. An intrusion detection system as claimed in claim 1, and further comprising adjustment means, coupled to the vibration sensor, for varying the amplitude of vibration-causing movement required to provide an output signal to the timing means.

8. An intrusion detection system for producing an alarm signal responsive to the repetition of a vibration-causing movement, comprising:

a vibration sensor, connected to produce an output signal responsive to each occurrence of the vibration-causing movement;

timing means, including a timer circuit coupled to the vibration sensor and operative, upon receipt of the first output signal from said sensor, to initiate a timing interval of preset duration, and further including a delay circuit, coupled to the timer circuit and operative, concomitantly with initiation of the timing interval, to initiate a predetermined delay time period shorter than the timing interval to establish a sensing window commencing with expiration of the delay time and ending with expiration of the timing interval;

a gate circuit, connected to be armed at the expiration of said delay time and to be triggered upon receipt of the first sensor output signal subsequent to the expiration of the predetermined delay time and prior to the expiration of said sensing window, thus producing the alarm signal only providing at least one additional sensor output signal is produced during the period of the sensing window; and a transducer coupled to the gate circuit, for translating the alarm signal into a system output signal.

9. An intrusion detection system as claimed in claim 8, in which the predetermined delay time is of the order of 0.5 to 2.0 seconds.

10. An intrusion detection system as claimed in claim 8, in which the sensing window period is of the order of 0.5 to 5.0 seconds.

11. An intrusion detection system as claimed in claim 8, in which the transducer is a piezoelectric horn for converting the alarm signal into an audible output signal.

12. An intrusion detection system as claimed in claim 8, further comprising a battery for energizing the system, and an integrated circuit stage including a comparator means, operable periodically to monitor the battery output under load conditions, and to provide a low-battery signal when the battery output falls below a preset level.

13. An intrusion detection system as claimed in claim 12, and further comprising adjustment means, coupled to the vibration sensor, for varying the amplitude of vibration-causing movement required to provide an output signal to the timer circuit.

14. An intrusion detection system as claimed in claim 13, in which the adjustment means additionally controls system energization and deenergization, and in which said integrated circuit stage comprises logic means connected to maintain propagation of the audible output signal for a predetermined time period even if the adjustment means has been actuated to deenergize the system.

* * * * *